United States Patent [19]

Range et al.

[11] 4,324,599

[45] Apr. 13, 1982

[54] GELLED SLURRY EXPLOSIVE

[75] Inventors: Kenneth Range, Arlington, Va.; William J. Irwin, Port Hueneme, Calif.; Russell Reed, Jr.; Wallace E. Silver, both of Ridgecrest, Calif.

[73] Assignee: The United States of America as repesented by the Secretary of the Navy, Washington, D.C.

[21] Appl. No.: 144,483

[22] Filed: Apr. 28, 1980

[51] Int. Cl.[3] ..... C06B 33/10

[52] U.S. Cl. ..... 149/39; 149/43; 149/44; 149/98

[58] Field of Search ..... 149/39, 43, 44, 98

[56] References Cited

U.S. PATENT DOCUMENTS 3,959,044 5/1976 Young ..... 149/38 X

*Primary Examiner*—Stephen J. Lechert, Jr.

*Attorney, Agent, or Firm*—Robert F. Beers; W. Thom Skeer

[57] ABSTRACT

An explosive slurry containing red water, a nitrocellulose containing propellant, oxidizer, passivated aluminum and a thickening agent.

8 Claims, No Drawings

GELLED SLURRY EXPLOSIVE

BACKGROUND OF THE INVENTION

1. Field of the Invention

The present invention relates to explosives. More particularly, it relates to gelled slurry explosives which can be made from waste products formed in the manufacturing of explosives and from excess gun and rocket propellants.

2. Description of the Prior Art

The purification process in TNT manufacture involves the use of sellite. Sellite is a concentrated (16%) solution of sodium sulfite. Crude TNT is washed with sellite and the 3 to 5% of unwanted isomers of TNT (TNT with nitro groups attached to the 3 and 5 positions on the benzene ring) react with it leaving the desired 2,4,6-TNT (α-TNT). These unwanted TNT isomers and various amounts of other aromatic nitro compounds which are also washed out are called nitrobodies. The wash solution (sellite plus products of the reaction between sodium sulfite and the undesired TNT isomers and other nitro-bodies) is called red water. Since red water contains nitro-bodies and sodium nitrate and nitrite it is an energetic material capable of providing energy in a gelled slurry explosive.

Great amounts of red water are produced yearly in TNT manufacture. For every 100 pounds of TNT produced, about 100 gallons of red water are generated.

Currently, there is a limited market for red water in the paper industry and, accordingly, ammunition plants can dispose of some of the red water that they generate by selling it to paper making plants. However, the paper industry only uses a small portion of the red water generated in this country and the rest of the red water must be disposed of. The balance is considered undesirable waste.

Improvements in paper manufacturing processes may result in the elimination of the use of red water. Disposal of the aforementioned undesirable waste is accomplished by partial evaporation followed by incineration. The incineration process is time consuming and expensive. Accordingly, it would be desirable if some use for red water other than that made by the paper industry could be found.

Certain now obsolete ship-to-shore bombardment rockets used what is commonly known as JPN double-base propellant. The nominal composition of JPN double-base propellant is well known and as used herein shall refer to that propellant the composition of which is:

| Component | Weight % |
|---|---|
| Nitrocellulose (13.25% N) | 51.39 |
| Nitroglycerin | 42.90 |
| Diethyl phthalate | 3.24 |
| Ethyl Centralite | 1.00 |
| Potassium Sulfate | 1.25 |
| Candelilla Wax | 0.02 |
| Carbon Black | 0.20 |

Because these rockets are now obsolete it would be desirable if some use for the outmoded JPN double-base propellant could be found. Furthermore, there are many other sources of excess nitrocellulose and double-base propellant. A large amount of nitrocellulose gun propellant is declared excess each year. As in the case of red water, a use for some or all of this propellant would be desirable.

Sodium nitrate is produced in large quantities as a by-product in the manufacturing of RDX. More uses for it would be desirable.

Various schemes have been devised to permit recovery of flake or powdered aluminum from outmoded aluminized explosives. Thus, such aluminum becomes a waste product of the explosives industry. Uses for it are being sought.

SUMMARY OF THE INVENTION

According to this invention, a gelled slurry explosive composition which makes use of the abovementioned waste products is provided. The preferred composition contains about 35 weight percent red water, about 46 weight percent ground JPN double-base propellant, about 10 weight percent of an oxidizer which may either be ammonium nitrate or sodium nitrate and about 8.5 weight percent flake or powdered aluminum which has been passivated by treatment with alkyl phosphoric acid.

DESCRIPTION OF THE PREFERRED EMBODIMENT

Red water is a solution which contains approximately 75 weight percent water, approximately 17 weight percent nitro-bodies, approximately 2 weight percent sodium sulfite, approximately 1 weight percent sodium sulfate, approximately 4 weight percent sodium nitrite and approximately 1 weight percent sodium nitrate. Analysis of one batch showed the following composition:

| Component | Weight % |
|---|---|
| Water | 75 |
| Mixed Organic Nitro-bodies | 17.3 |
| Sodium Sulfite | 2.3 |
| Sodium Sulfite | 0.6 |
| Sodium Nitrite | 3.5 |
| Sodium Nitrate | 1.3. |

The nominal composition of JPN double base propellant has been given above.

The oxidizers ammonium nitrate and sodium nitrate, whether they be obtained as a waste from an ammunition plant or by some other means are well known as is passivated flake and powdered aluminum. (The term "passivated" means that the aluminum is unreactive with water after having been treated with alkyl phosphoric acid.)

The primary purpose of this invention is to provide a use for the aforementioned waste products and especially for red water. Accordingly, the best mode for practicing this invention involves forming a slurry by mixing red water, ground JPN double-base propellant, either ammonium nitrate or sodium nitrate oxidizer, passivated flake or powdered aluminum and a thickener. Guar gum is suitable as a thickener. To form the slurry, the various materials with the exception of the thickener are agitated at a temperature of about 160° F. and then cold water is added to bring the temperature down to about 140° F. and the pH to about 4.4. When the temperature reaches about 140° F., the thickener is added.

Preferably the slurry contains about 10 weight percent oxidizer, about 35 weight percent red water concentrate (red water that has been concentrated to contain about 35% solids), about 46 weight percent ground JPN double base propellant, about 8.5 weight percent passivated flake or powdered aluminum and about 0.5 weight percent thickening agent.

Slurried explosive can be transported by truck or pipe line and can be gelled at will by adding tolylene diisocyanate.

The gelled slurry can be detonated by any conventional electric or non-electric blasting cap.

Since one of the primary purposes of this invention is to provide a use for outmoded JPN double-base propellant, the best mode of practicing the invention involves the use of that propellant. However, any nitrocellulose containing gun or rocket propellant may be used.

In a like manner, an oxidizer such as potassium perchlorate or the like could be used in lieu of the nitrates set forth above.

Thickeners other than Guar gum may also be used. For example, various polysacharides, various celluloses such as hydroxypropyl or hydroxyethyl cellulose and polyethyleneglycol thickeners would be suitable.

Specific weight percentages have been set forth for the red water, double base propellant, etc. These may be varied. For example, the weight percentage of red water used may be in the range of from 20 to 40, the weight percent of nitrocellulose containing propellant in the range of from 20 to 50, the weight percent of the oxidizer in the range of from 10 to 25, the weight percent of passivated aluminum in the range of from 7 to 10, and from 0.3 to 0.8 weight percent thickening agent may be used. From about 0.125 to 0.25 weight percent tolylene diisocyanate is sufficient to gel the slurried explosive.

We claim:

1. An explosive composition comprising:

about 20 to about 40 weight percent "red water", a mixture of sellite and reaction products of sodium sulfite and trinitrotoluene isomers which includes sodium sulfite, sodium sulfate, sodium nitrite, sodium nitrate and water, such "red water" mixture being a by-product of the manufacture of trinitrotoluene, about 20 to about 50 weight percent of propellant nitrocellulose;

about 10 to about 25 weight percent oxidizer;

about 7 to about 10 weight percent passivated aluminum; and about 0.3 to 0.8 weight percent thickening agent.

2. An explosive composition according to claim 1 wherein said nitrocellulose containing propellant is double base propellant.

3. An explosive composition according to claim 1 wherein said oxidizer is selected from the group consisting of ammonium nitrate and sodium nitrate.

4. An explosive composition according to claim 1 wherein said thickening agent is guar gum.

5. An explosive composition according to claim 1 wherein there are 35 weight percent red water, 46 weight percent nitrocellulose containing propellant, 10 weight percent oxidizer, 8.5 weight percent passivated aluminum and 0.5 weight percent thickening agent.

6. An explosive composition according to claim 2 wherein the oxidizer is selected from the group consisting of ammonium nitrate and sodium nitrate.

7. An explosive composition according to claim 6 wherein the thickening agent is guar gum.

8. An explosive composition according to claim 7 which contains 35 weight percent red water, 46 weight percent double-base propellant, 10 weight percent of an oxidizer selected from the group consisting of ammonium nitrate and sodium nitrate and 0.5 weight percent guar gum.

* * * * *